US007900286B2

(12) United States Patent
Black

(10) Patent No.: US 7,900,286 B2
(45) Date of Patent: Mar. 8, 2011

(54) SUPPORT FOR WALL-MOUNTED TOILET

(76) Inventor: Joel Allen Black, Hermitage, PA (US)

( * ) Notice: Subject to any disclaimer, the term of this patent is extended or adjusted under 35 U.S.C. 154(b) by 0 days.

(21) Appl. No.: 11/758,957

(22) Filed: Jun. 6, 2007

(65) Prior Publication Data

US 2007/0277298 A1 Dec. 6, 2007

Related U.S. Application Data

(60) Provisional application No. 60/811,247, filed on Jun. 6, 2006.

(51) Int. Cl.
*E03D 11/14* (2006.01)
*E03D 11/00* (2006.01)

(52) U.S. Cl. ..... 4/252.1

(58) Field of Classification Search ..... 4/252.2, 4/252.1; 248/346.04, 346.3, 261, 354.3, 248/405, 583, 599, 600, 602, 616, 634; 254/101
See application file for complete search history.

(56) References Cited

U.S. PATENT DOCUMENTS

| | | | | | |
|---|---|---|---|---|---|
| 906,028 | A | * | 12/1908 | Jennison | 254/100 |
| 1,193,278 | A | * | 8/1916 | Luce | 254/100 |
| 1,833,082 | A | * | 11/1931 | Klee et al. | 254/101 X |
| 1,942,088 | A | * | 1/1934 | Dietrich | 248/354.3 X |
| 2,181,163 | A | * | 11/1939 | Akins | 254/101 |
| 2,535,613 | A | * | 12/1950 | Vanderbeek | 248/188.4 |
| 2,702,075 | A | * | 2/1955 | Richards | 248/405 X |
| 2,762,599 | A | * | 9/1956 | Faris | 254/100 |
| 3,006,606 | A | * | 10/1961 | Pohl et al. | 254/101 |
| 3,191,212 | A | * | 6/1965 | Reiss | 16/42 R |
| 3,667,736 | A | * | 6/1972 | Kolmar | 366/27 |
| 4,144,597 | A | | 3/1979 | Guenther et al. | |
| 4,174,546 | A | | 11/1979 | Ohtake | |
| 4,441,218 | A | | 4/1984 | Trybom | |
| 4,554,689 | A | | 11/1985 | Segler | |
| 4,726,079 | A | | 2/1988 | Signori et al. | |
| 4,794,653 | A | | 1/1989 | Strasser | |
| 5,150,480 | A | | 9/1992 | Schmucki | |
| 5,809,583 | A | | 9/1998 | Pucciani | |
| 6,553,582 | B1 | | 4/2003 | Clark | |
| 6,889,392 | B1 | | 5/2005 | Karnopp et al. | |
| 7,089,604 | B2 | | 8/2006 | Wright et al. | |
| 7,146,655 | B2 | | 12/2006 | Karnopp et al. | |

* cited by examiner

*Primary Examiner* — Lori Baker
(74) *Attorney, Agent, or Firm* — Allan G. Towner, Esq.; Pietragallo Gordon Alfano Bosick & Raspanti, LLP

(57) ABSTRACT

An adjustable toilet support designed to be installed under wall mounted toilets in order to increase their load bearing capacities is disclosed. The toilet support comprises a base which rests on the floor below the toilet, a sleeve surrounding an upper portion of the base, and a contact member that contacts the underside of the toilet bowl. The sleeve and swivel ball are height adjustable with respect to the base by means of a support rod connected to the contact member and threaded into a nut contained inside the base. The support rod has an upper ball that fits within a socket under the contact member. The contact member may be in the shape of a swivel ball having a generally spherical side surface that contacts and holds the upper rim of the sleeve. During installation, the toilet support is positioned under the toilet, and the base is rotated while the sleeve, contact member and support rod are held against rotation, which causes the contact member to rise and contact the toilet bowl.

24 Claims, 5 Drawing Sheets

SUPPORT FOR WALL-MOUNTED TOILET

CROSS-REFERENCE TO RELATED APPLICATION

This application claims the benefit of U.S. Provisional Patent Application Ser. No. 60/811,247 filed Jun. 6, 2006, which is incorporated herein by reference.

FIELD OF THE INVENTION

The present invention relates to toilet supports, and more particularly relates to supports that are mounted below wall-mounted toilets to increase their load bearing capacity.

BACKGROUND INFORMATION

Wall-mounted toilets have limited load bearing capacities. It would be desirable to provide a support structure which increases the load bearing capacity of wall-mounted toilets. It would also be desirable to provide an adjustable toilet support that can be adapted for use with different types of toilet designs.

SUMMARY OF THE INVENTION

The present invention provides an adjustable toilet support designed to be installed under wall mounted toilets in order to increase their load bearing capacities. The toilet support comprises a base which rests on the floor below the toilet, a sleeve surrounding an upper portion of the base, and a contact member that contacts the underside of the toilet bowl. The sleeve and contact member are height adjustable with respect to the base by means of a support rod connected to the contact member and threaded into a nut contained in the base. The support rod has an upper ball that fits in a socket under the contact member. In one embodiment of the invention, the contact member is in the shape of a swivel ball having a generally spherical side surface that contacts the inner diameter of the sleeve near the top of the sleeve. During installation, the toilet support is positioned under the toilet, and the base is rotated while the sleeve, contact member and support rod are held against rotation, thereby causing the contact member to rise and contact the toilet bowl.

An aspect of the present invention is to provide a toilet support comprising: a base structured and arranged to rest on a floor below a toilet, and an extendable contact member extendable from the base, wherein the extendable contact member is structured and arranged to contact an underside of the toilet when the extendable contact member is extended from the base.

Another aspect of the present invention is to provide a toilet support comprising: a base structured and arranged to rest on a floor below a toilet, and a rotatable contact member rotatably connected to the base, wherein the rotatable contact member is structured and arranged to contact an underside of the toilet.

A further aspect of the present invention is to provide a toilet support comprising: a base, a support rod threadably engaged in the base, and a contact member mounted on the support rod, wherein the contact member is structured and arranged to contact an underside of a toilet.

Another aspect of the present invention is to provide a toilet support comprising: a base, a contact member structured and arranged to contact an underside of a toilet, and a resilient coupling between the base and the contact member for absorbing downward forces applied from the toilet through the contact member.

A further aspect of the present invention is to provide a method of supporting a toilet. The method comprises the steps of placing a toilet support below the toilet, and extending a contact member from a base of the toilet support to contact an underside of the toilet.

These and other aspects of the present invention will be more apparent from the following description.

DETAILED DESCRIPTION

Figure 1:
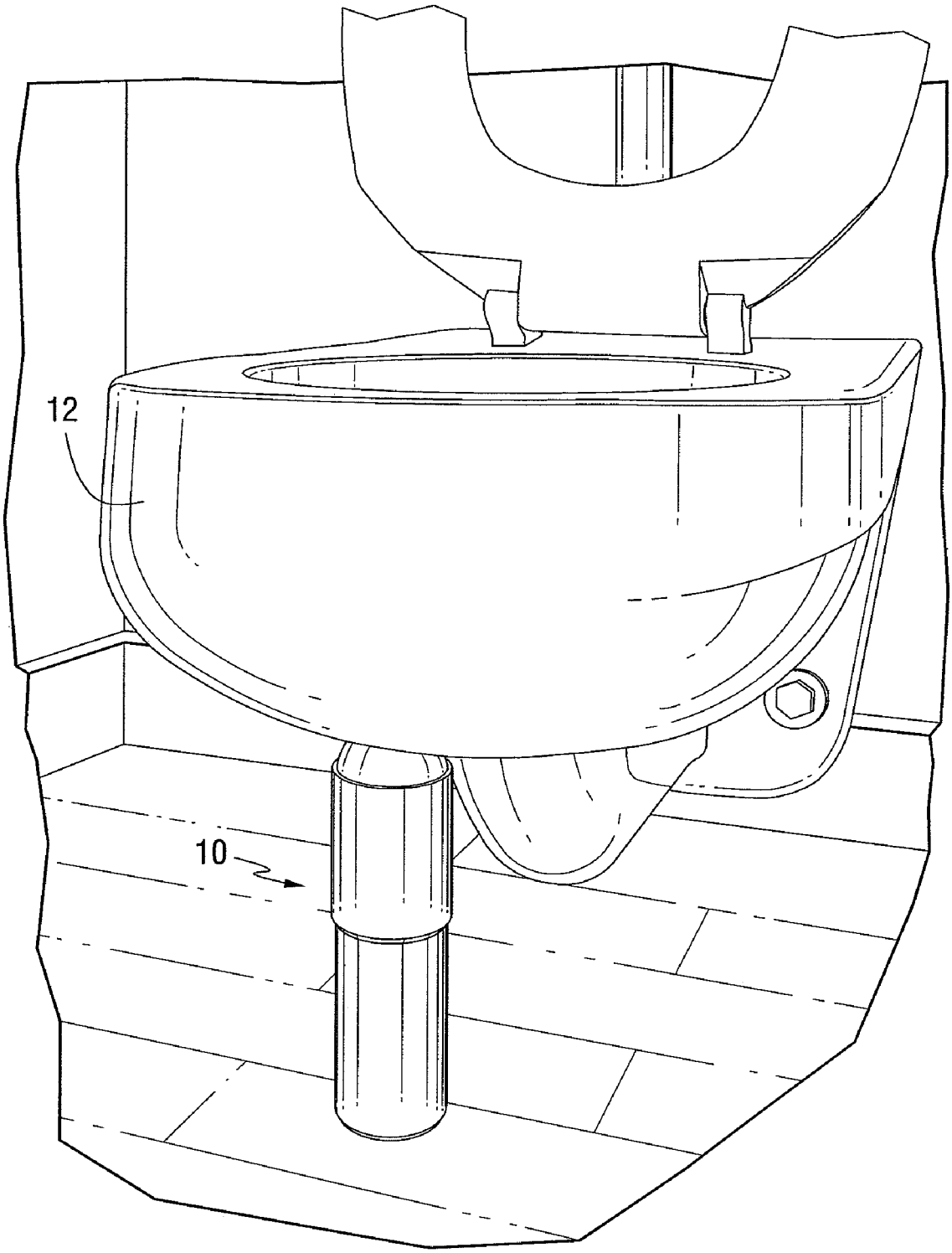
FIG. 1 is an isometric view of a toilet support mounted under a wall-mounted toilet in accordance with an embodiment of the present invention.
Figure 2:
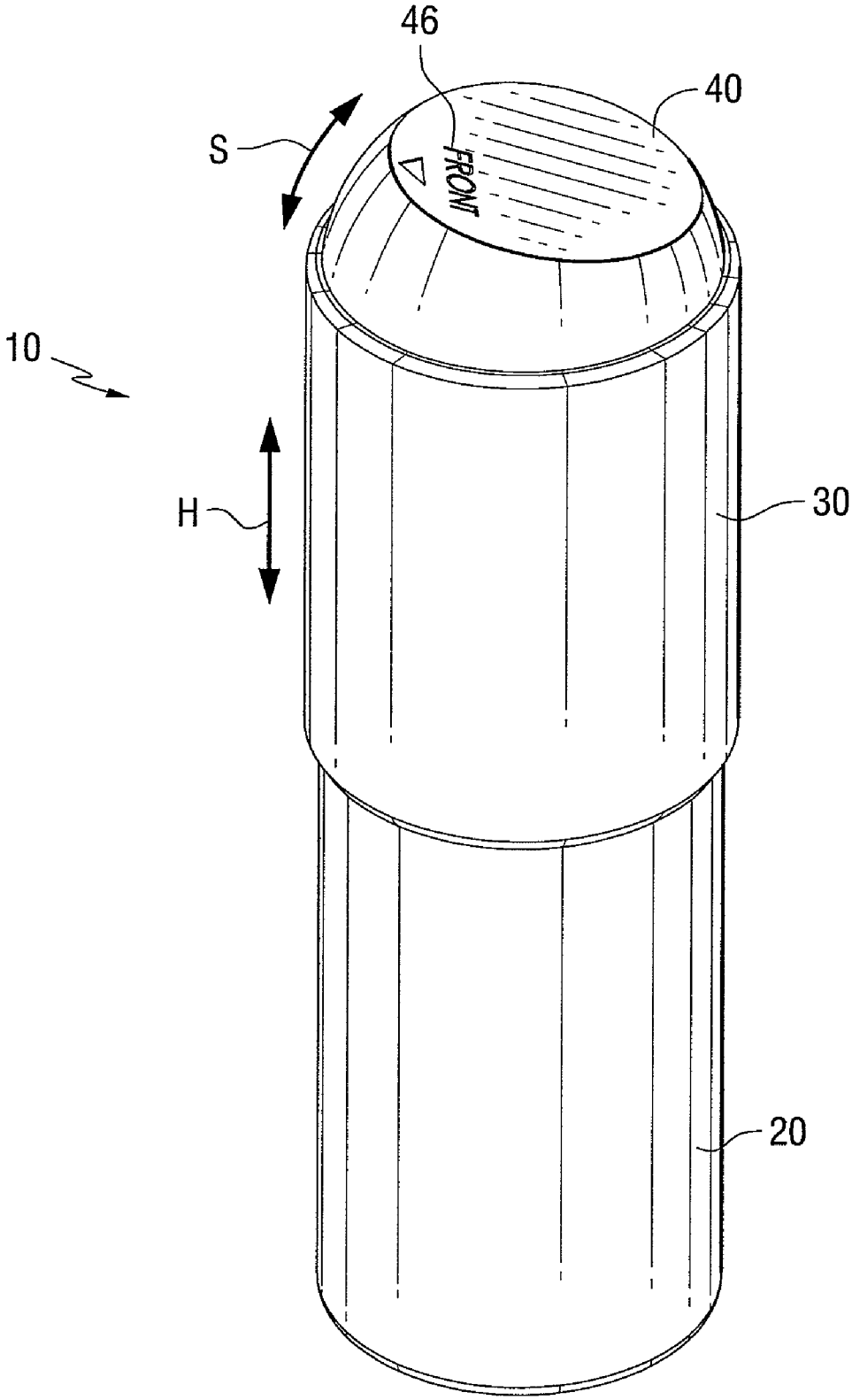
FIG. 2 is an isometric view of a toilet support in accordance with an embodiment of the present invention.
Figure 3:
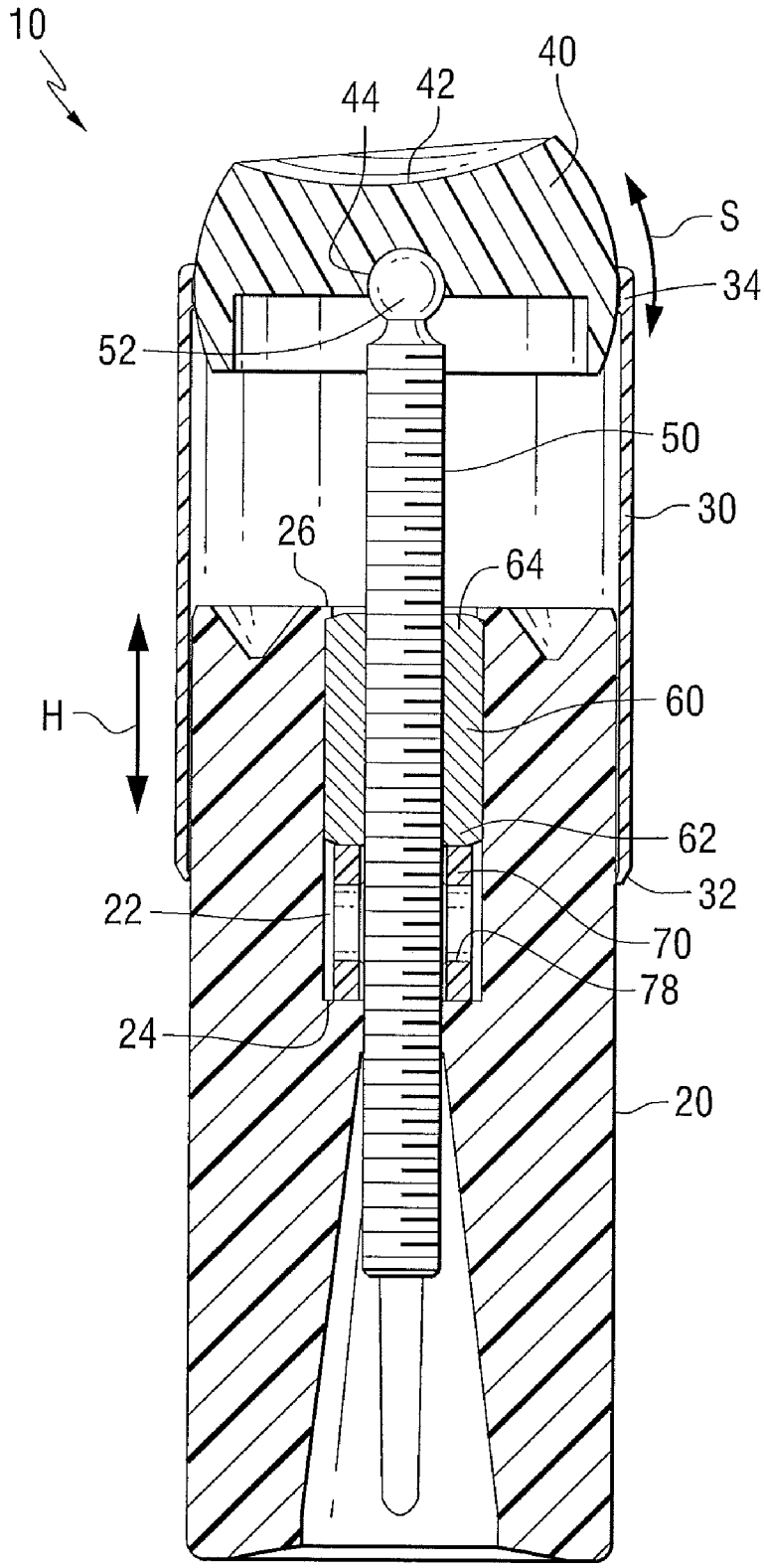
FIG. 3 is a side sectional view of a toilet support in accordance with an embodiment of the present invention.

FIG. 1 illustrates an adjustable toilet support 10 of the present invention installed under a toilet bowl 12 of a wall-mounted toilet. FIG. 2 is an isometric view and FIG. 3 is a side sectional view of the toilet support 10. The support 10 includes a base 20, a sleeve 30 and a contact member in the form of a swivel ball 40. The base 20 and sleeve 30 are generally cylindrical, and the contact member 40 has a generally spherical outer surface in the embodiment shown. As shown most clearly in FIG. 3, the toilet support 10 also includes a threaded rod 50, hexagonal nut 60 and compression spring 70.

Figure 4:
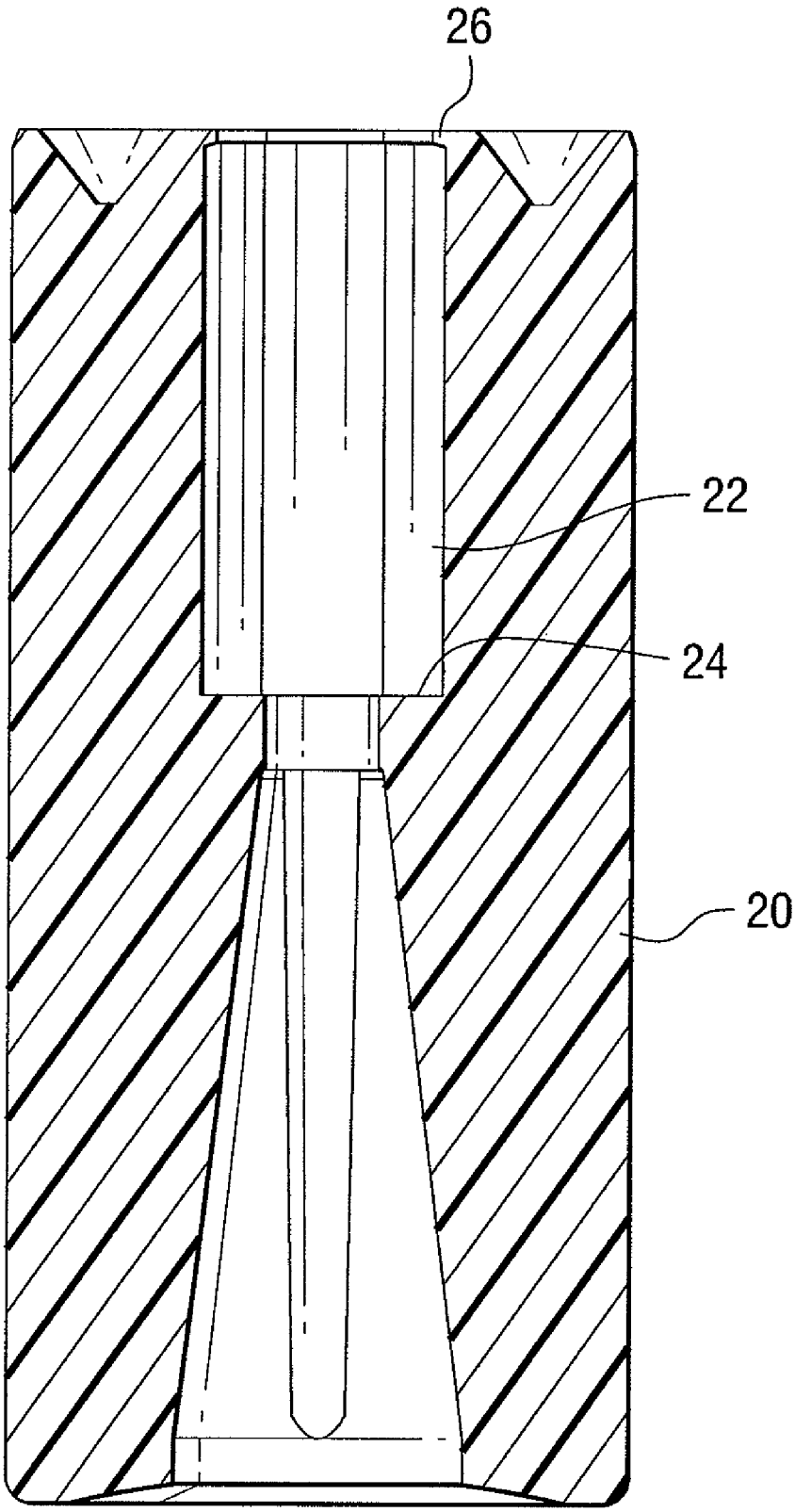
FIG. 4 is a side sectional view of a base member of a toilet support in accordance with an embodiment the present invention.

As shown in FIGS. 3 and 4, the base 20 includes a central bore 22 having a hexagonal cross section terminating in a lower shoulder 24. The upper opening of the central bore 22 includes a radially inwardly extending lip or detent 26.

The sleeve 30 has a bottom end 32 that may optionally have a slightly reduced inner diameter approximating the outer diameter of the base 20. The sleeve 30 has a top end 34 which has two small radially inwardly extending rings which contact the spherical outer surface of the swivel ball 40. This arrangement provides a snap fit in which the swivel ball 40 may rotate within the sleeve against the frictional forces between the radially inwardly extending rings and the outer spherical surface of the swivel ball 40.

Figure 5:
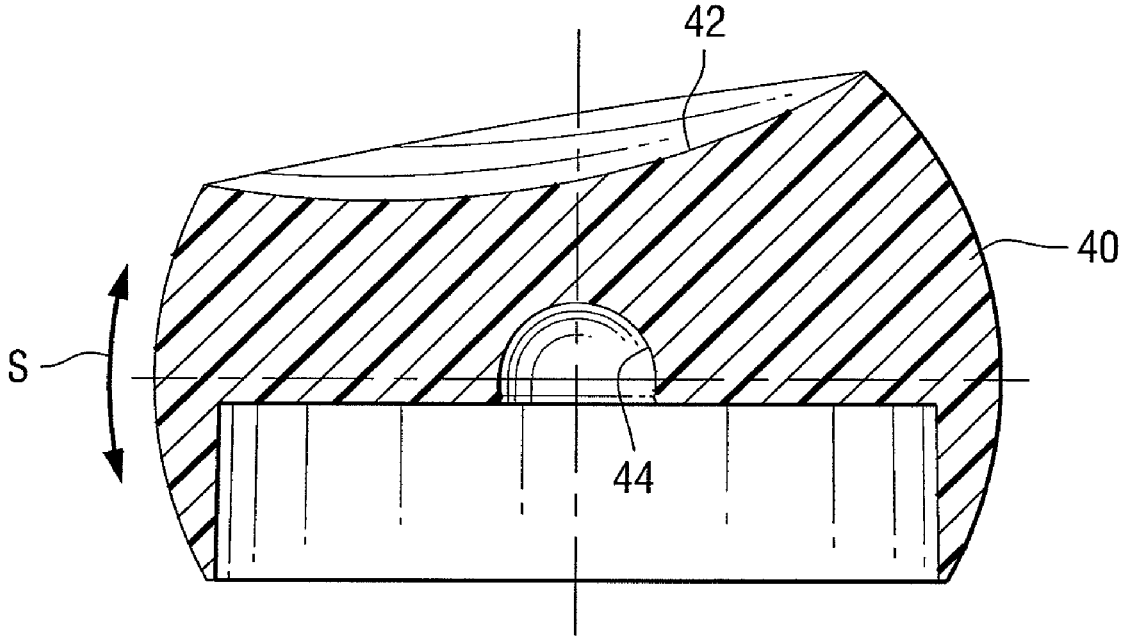
FIG. 5 is a side sectional view of a contact member of a toilet support in accordance with an embodiment of the present invention.

The swivel ball 40 has a concave upper surface 42 for contacting the underside of the toilet bowl 12. The intersection of the concave upper surface 42 and the spherical outer surface of the swivel ball 40 forms a circular edge which, in the embodiment shown in FIG. 3, lies in a non-horizontal plane. Although a concave surface 42 is shown in the figures, any other suitable surface for contacting the underside of a toilet may be used in accordance with the present invention. As shown most clearly in FIGS. 3 and 5, the swivel ball 40 has an interior spherical socket 44 adapted to receive a spherical pivot head or ball 52 of the rod 50. The ball 52 is inserted in the socket 44 and is retained by a detent formed by a slight lip provided at the opening of the socket 44. This arrangement allows the swivel ball 40 to pivot in any desired direction with respect to the rod 50 and ball 52 against the frictional forces between the ball 52 and socket 44, while retaining the swivel ball 40 on the rod 50. As shown most clearly in FIG. 2, alignment markings 46 may be provided on the contact surface 42 of the swivel ball 40 in order to assist in orientation of the toilet support 10 under the toilet bowl 12.

As shown most clearly in FIG. 3, the hexagonal nut 60 is threaded on the rod 50 and is mounted in the hexagonal central bore 22 of the base 20. The top 64 of the nut 60 contacts the detent 26 to thereby retain the nut 60 in the hexagonal central bore 22. In this manner, the nut 60 is prevented from rotating with respect to the base 20 and is retained in the central bore 22, but is permitted to slide downward slightly in the bore 22. The generally cylindrical compression spring 70 surrounds the rod 50 and is supported in the central bore 22 by the lower shoulder 24. The bottom end 62 of the nut 60 rests on the top of the compression spring 70.

Figure 6:
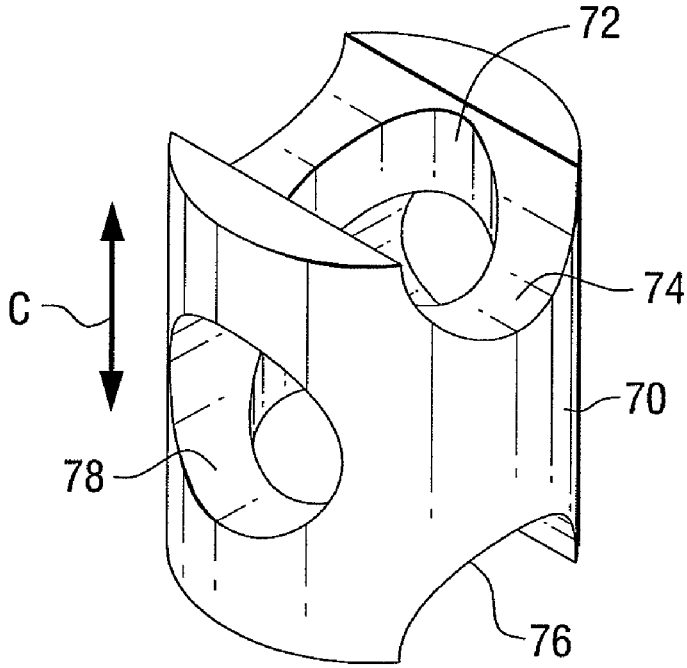
FIG. 6 is an isometric view of a compression spring of a toilet support in accordance with an embodiment of the present invention.

Details of the compression spring 70 are shown in FIG. 6. The spring 70 has a central vertical hole 72, an upper saddle-shaped cutout 74, a lower saddle-shaped cutout 76 and a middle horizontal hole 78. The spring 70 may be compressed in the direction of arrow C in FIG. 6. The compression spring 70 may be made of any suitable resilient material such as injection molded or machined polyurethane.

As shown by the arrow H in FIGS. 2 and 3, the overall height of the toilet support 10 is vertically adjustable. Rotation of the base 20 around its vertical axis while securing the sleeve 30 against rotation causes the rod 50 to move upward or downward due to its threaded engagement in the stationary nut 60. The frictional engagement between the sleeve 30 and spherical surface of the swivel ball 40, and the frictional engagement between the socket 44 and the ball 52 of the rod 50, cause the sleeve 30, swivel ball 40 and rod 50 to rotate as a unit when the sleeve 30 is rotated. Rotation of the threaded rod 50 with respect to the stationary nut 60 in the base 20 causes the rod 50, swivel ball 40 and sleeve 30 to move vertically with respect to the base 20. The height adjustment H feature allows the toilet support 10 to be mounted under toilet bowls of different heights, and allows the toilet support 10 to be secured between the floor and toilet bowl with a controlled amount of vertical force.

In addition to the height H adjustment, the swivel ball 40 is freely rotatable on the pivot head 52 of the rod 50 such that it can swivel in any direction against any frictional forces between the ball 52 and socket 44, such as the swivel direction S shown in the figures. The ability of the swivel ball 40 to rotate in any desired direction facilitates installation of the toilet support 10 under toilet bowls of different shapes.

The use of the compression spring 70 in accordance with the present invention provides a shock-absorbing affect when downward forces from the toilet bowl 12 force the swivel ball 40 and rod 50 downward. Downward force on the rod 50 forces the nut 60 downward a small distance in the central bore 22 against the force of the compression spring 70.

In one embodiment, the base and sleeve assembly may be approximately two inches in diameter, and may range from 5 to 12 inches tall. However, any other suitable size may be used.

The base 20, sleeve 30 and swivel ball 40 may be made of any suitable material such as plastic. For example, they may be thermoplastic injection molded parts, e.g., a 40 percent talc filled polyethylene or the like. The rod 50 and nut 60 may be made of metal such as carbon steel which may be zinc coated. In one embodiment of the invention, only the plastic parts are exposed to the environment, while the steel components are contained within the assembly.

The toilet support 10 may be assembled as follows. The compression spring 70 is inserted in the hexagonal central bore 22 of the base, followed by insertion of the nut 60 into the central bore 22 past the detents 26. This assembly allows the nut 60 to compress the spring 70 when it is pressed downward, but contains both the spring 70 and nut 60 in the base component 20. The upper ball 52 of the support rod 50 is snapped into the socket 44 of the swivel ball 40 past the detent formed at the opening of the socket 44. The sleeve 30 is slid down over the base 20, then the support rod 50 with the attached swivel ball 40 is threaded through the nut 60. To complete the assembly, the sleeve 30 is slid upward over the swivel ball 40 and snaps into place on the swivel ball 40 due to contact with the rings at the top 34 of the sleeve 30.

The overall height of the toilet support 10 can be simply adjusted to fit under the toilet 12 by turning the base 20 while the swivel ball 40 and sleeve 30 are maintained in position. The unit should be adjusted to fit between the floor and the toilet bowl 12 keeping the base 20 perpendicular to the floor and centered under the bowl 12 front to back and side to side as well as possible. With the base 20 squarely on the floor the concave surface 42 of the swivel ball 40 should make contact with the bowl surface as closely as possible. Final installation of the support unit under the toilet is accomplished by using an adhesive caulk to secure the base to the floor and the swivel ball to the toilet bowl.

In accordance with an embodiment of the present invention, the following instructions may be followed when installing the toilet support. The toilet bowl and floor should be cleaned prior to installation, such that dirt and wax are removed. Cleaning products which include petroleum-based solvents or which may leave a film should be avoided because they may adversely effect bonding of the silicone adhesive. The toilet support should be centered at the lowest point of the toilet bowl with the "front" impression on the top of the swivel ball aligned with the front of the bowl. The toilet support should be both square to the floor and centered under the bowl. The support may be adjusted by securely holding the sleeve in the desired position and twisting the base of the unit clockwise until it has come firmly into contact with both the floor and bottom of the bowl. Care should be taken not to overtighten the unit. Once the height of the support has been adjusted, it is removed and silicone adhesive is applied in the socket on top of the ball and to the bottom of the base. The support is then reinstalled under the bowl ensuring that it is squarely centered and that the ball is in contact with the bowl. An additional bead of silicone adhesive may be used around the ball and base. In addition, a small bead of the silicone adhesive may be provided around the joint at the perimeter of the ball and sleeve to ensure a leak-free joint.

During use, as the toilet is pressed down, the swivel ball 40 and rod 50 assembly will force the nut 60 to compress the spring 70. This will absorb the initial shock and allow the toilet hanger to accept only a portion of the load. The compression spring 70 only deflects a given amount at which point the unit becomes a rigid support, thus enabling the toilet to support a greater load than it could typically support.

Whereas particular embodiments of this invention have been described above for purposes of illustration, it will be evident to those skilled in the art that numerous variations of the details of the present invention may be made without departing from the invention as defined in the appended claims.

The invention claimed is:

1. A toilet support for increasing the load bearing capacity of a wall-mounted toilet, comprising:

a base structured and arranged to rest on a floor below the wall-mounted toilet;

a sleeve surrounding an upper portion of the base; and an extendable contact member mounted in an upper portion of the sleeve and extendable from the base, wherein the extendable contact member comprises an upper surface which is structured and arranged to contact an underside of the wall-mounted toilet when the extendable contact member and sleeve are extended from the base, and wherein the sleeve is substantially cylindrical, the extendable contact member comprises a substantially spherical outer surface, and the sleeve is connected to the extendable contact member by contact between an inner surface of the substantially cylindrical sleeve and the substantially spherical outer surface of the contact member.

2. The toilet support of claim 1, wherein the extendable contact member is mounted on a support rod that is connected to the base, the extendable contact member is rotatably mounted on the support rod, and the extendable contact member is rotatable in a vertical plane.

3. The toilet support of claim 1, wherein the support rod is threaded.

4. The toilet support of claim 3, wherein the threaded support rod is threaded into a nut supported by the base.

5. The toilet support of claim 4, wherein the nut is secured against rotation with respect to the base.

6. The toilet support of claim 5, wherein the nut is movable in a vertical axial direction of the base.

7. The toilet support of claim 6, further comprising a spring for absorbing vertical downward force applied to the nut.

8. The toilet support of claim 7, wherein the spring and nut are located in a central bore in the base, and the nut has a lower end that rests on the spring.

9. The toilet support of claim 1, wherein the extendable contact member is mounted on a support rod that is connected to the base, the extendable contact member is rotatably mounted on the support rod, and the extendable contact member comprises a socket and the support rod comprises an upper ball inserted in the socket.

10. The toilet support of claim 9, wherein an opening of the socket forms a lip for retaining the ball in the socket.

11. The toilet support of claim 1, wherein the extendable contact member is mounted on a support rod that is connected to the base, the extendable contact member is rotatably mounted on the support rod, and the extendable contact member is rotatable in a horizontal plane.

12. The toilet support of claim 1, wherein rotation of the sleeve around a longitudinal axis of the sleeve causes rotation of the extendable contact member around the longitudinal axis of the sleeve.

13. The toilet support of claim 12, wherein the extendable contact member is rotatable with respect to the sleeve in a vertical plane.

14. The toilet support of claim 1, wherein the base comprises a substantially cylindrical outer surface.

15. The toilet support of claim 1, wherein the extendable contact member comprises a concave upper surface which is structured and arranged to contact an underside of the wall-mounted toilet when the extendable contact member and sleeve are extended from the base.

16. The toilet support of claim 15, wherein the extendable contact member is rotatable in vertical and horizontal planes.

17. The toilet support of claim 15, wherein the concave upper surface and the substantially spherical outer surface of the extendable contact member form a circular edge.

18. The toilet support of claim 17, wherein the circular edge lies in a non-horizontal plane.

19. The toilet support of claim 1, further comprising a resilient coupling between the base and the contact member for absorbing downward forces applied from the toilet through the contact member.

20. The toilet support of claim 19, wherein the resilient coupling comprises a compression spring.

21. The toilet support of claim 1, wherein the extendable contact member is rotatable in a horizontal plane.

22. The toilet support of claim 1, wherein the extendable contact member comprises a concave upper surface.

23. The toilet support of claim 22, wherein the concave upper surface and the substantially spherical outer surface of the extendable contact member form a circular edge.

24. The toilet support of claim 23, wherein the circular edge lies in a non-horizontal plane.

* * * * *